United States Patent [19]

Pereira

[11] 4,185,686

[45] Jan. 29, 1980

[54] SEALING APPARATUS FOR ROTARY HEAT EXCHANGERS

[75] Inventor: Joseph K. Pereira, Kingston-upon-Thames, England

[73] Assignee: British Steel Corporation, London, England

[21] Appl. No.: 845,671

[22] Filed: Oct. 26, 1977

[51] Int. Cl.[2] ..... F28D 19/00

[52] U.S. Cl. ..... 165/7; 165/9; 277/22; 277/81 S

[58] Field of Search ..... 165/8, 9, 7; 277/22, 277/81 S

[56] References Cited

U.S. PATENT DOCUMENTS

| | | | |
|---|---|---|---|
| 2,673,718 | 3/1954 | Ljungstrom | 165/9 X |
| 3,667,220 | 6/1972 | Debeyser | 165/8 X |
| 3,882,927 | 5/1975 | Penny | 165/8 X |
| 4,024,905 | 5/1977 | Guillot | 165/9 |
| 4,024,906 | 5/1977 | Bramley | 165/9 |

*Primary Examiner*—Albert W. Davis, Jr.

*Attorney, Agent, or Firm*—Bacon & Thomas

[57] ABSTRACT

Sealing apparatus is provided for a rotary heat exchanger of the regenerative type, in which the exchanger has a rotatable disc-like matrix having two opposed end faces and at least one pair of gas passages opening on to each end face of the matrix. The sealing apparatus seals at least one of the end faces for preventing leakage of gas between the two passages at the interface of the respective passage and end face and the sealing apparatus includes a plurality of sealing blocks arranged in end-to-end relation providing a flexible seal extending along the interface. Each of the blocks is of channel-shaped configuration, has a base bearing in sealing relation upon the respective end face of the matrix, and is mounted upon a respective guide member extending within the channel.

20 Claims, 10 Drawing Figures

SEALING APPARATUS FOR ROTARY HEAT EXCHANGERS

BACKGROUND OF THE INVENTION

This invention relates to a heat exchanger of the regenerative type wherein outgoing hot gases pass along a plurality of small diameter passages in a matrix, the heat stored therein subsequently being utilised to warm incoming cool gases.

One regenerative heat exchanger of this type is that known as a rotary regenerator wherein the matrix is in the overall form of a disc mounted for rotation in such manner that each of its end faces passes continuously between hot and cold gas flow passages. At the axial end faces of the matrix there are provided sealing means to maintain separate on the one end face, for example, incoming hot gas and outgoing heated air and on the opposed end face, incoming cold air and outgoing cooled waste gas.

SUMMARY OF THE INVENTION

It is an object of the present invention to provide a rotary heat exchanger having new or improved sealing means at its matrix end faces.

In accordande with one aspect of the invention there is provided a rotary heat exchanger of the regenerative type comprising a rotatable disc-like matrix having two opposed end faces, at least one pair of gas passages opening on to each said end face of the matrix and sealing means adjacent to at least one of said end faces for preventing leakage of gas between the two passages at the respective passage/end face interface; the sealing means comprising a plurality of sealing blocks arranged in end-to-end relation providing a flexible seal extending along the passage/end face interface, each block being of channel-shaped configuration having a base bearing in sealing relation upon the respective end face of the matrix and being mounted upon a respective guide member extending within the channel.

Such sealing means are conveniently provided at each of the end faces of the matrix and the sealing means at each said end face may comprise a pair of back-to-back generally D-shaped portions having a straight portion extending across the end face of the matrix between the two gas passages and having an arcuate portion extending around the periphery of the end face of the matrix.

The arcuate portions may conveniently be provided by several short straight seal units assembled in a lap jointed arrangement to form a curved barrier. Such an assembly will allow freedom for thermal growth and relative movement between blocks while maintaining barrier continuity by means of the longitudinal component of the frictional drag force encountered at the matrix face.

Conveniently the heat exchanger may be positioned with the matrix rotatable about a vertical axis in which case those sealing blocks which bear on the upper end face of the matrix may be biassed under gravity, possibly with fluid pressure or mechanically actuated assistance, on to said upper end face whilst those sealing blocks which bear on the lower end face of the matrix may be resiliently biassed upwardly into contact with said lower end face. In such an arrangement the two gas passages communicating with the upper end face of the matrix may conveniently handle incoming hot gas and outgoing heated air whilst the two gas passages in communication with the lower end face may handle incoming cold air and outgoing cooled waste gas thereby providing a "hot" upper end face of the matrix and a "cold" lower end face. The guide members for the sealing blocks which bear on the "hot" end face of the matrix may conveniently be liquid or gas cooled. Those sealing blocks which are biassed into engagement with the "cold" end face of the matrix may be resiliently biassed by fluid pressure or mechanical biassing means.

The sealing blocks are to be produced as U shaped metallic shoes which carry ceramic insulation, in either solid or fibre form, on the outside of the side walls, and a solid ceramic wearer base which is mechanically attached to the base of the shoe.

BRIEF DESCRIPTION OF THE DRAWINGS

Other features of the invention will become apparent from the following description given herein solely by way of example with reference to the accompanying drawings wherein.

DETAILED DESCRIPTION

Figure 1:
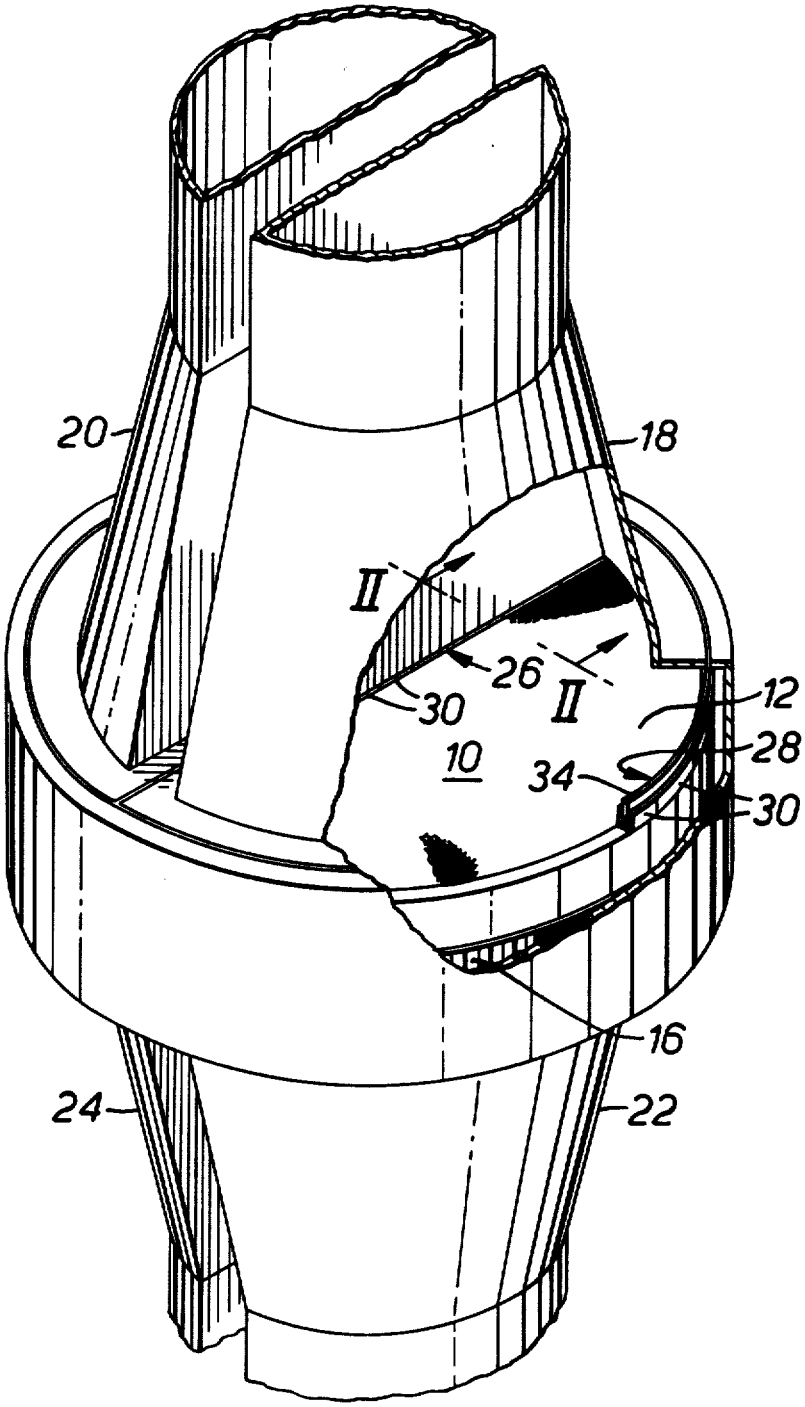
FIG. 1 is a partially cut away perspective view of a rotary heat exchanger in accordance with the invention having two gas passages at each end face of the matrix.

Referring to FIG. 1 of the drawings there is shown a rotary heat exchanger of the regenerative type typically intended for use in preheating air for delivery to a burner. The regenerator comprises a refractory or metallic disc-like or cylindrical matrix 10 having a plurality of small diameter passages arranged in a honeycomb structure and having two opposed generally parallel end faces 12 and 14. In use the regenerator would be mounted such that the matrix 10 is rotatable about a central vertical axis by an appropriate gear wheel and motor drive (not illustrated) engaging with a toothed rim 16 of the matrix. Gas and air ducts are connected to headers 18–20–22–24 which direct the streams of gas and air to flow through separate segments of the matrix 10. The upper headers 18–20 respectively direct incoming hot gas on to, and outgoing preheated air away from, the upper "hot" end face 12 of the matrix whilst the lower headers 22–24 respectively direct outgoing cooled waste gas away from, and incoming cold air on to, the lower "cold" end face 14 of the matrix.

A flexible seal extends between the two headers 18–20 and 22–24 at each respective end face of the matrix and, as will be seen from FIG. 1, each such seal is in the form of a pair of back-to-back D-shaped portions having a common straight portion 26 extending generally diametrically across each end face of the matrix at the juncture of the respective headers and having its arcuate portions 28 extending continuously around the whole periphery of the respective end face. The two headers on each end face may subtend sectors of differing surface area at the matrix end faces in which case each flexible seal may comprise two straight radial portions and an arcuate portion at the periphery of the end face.

Figure 2:
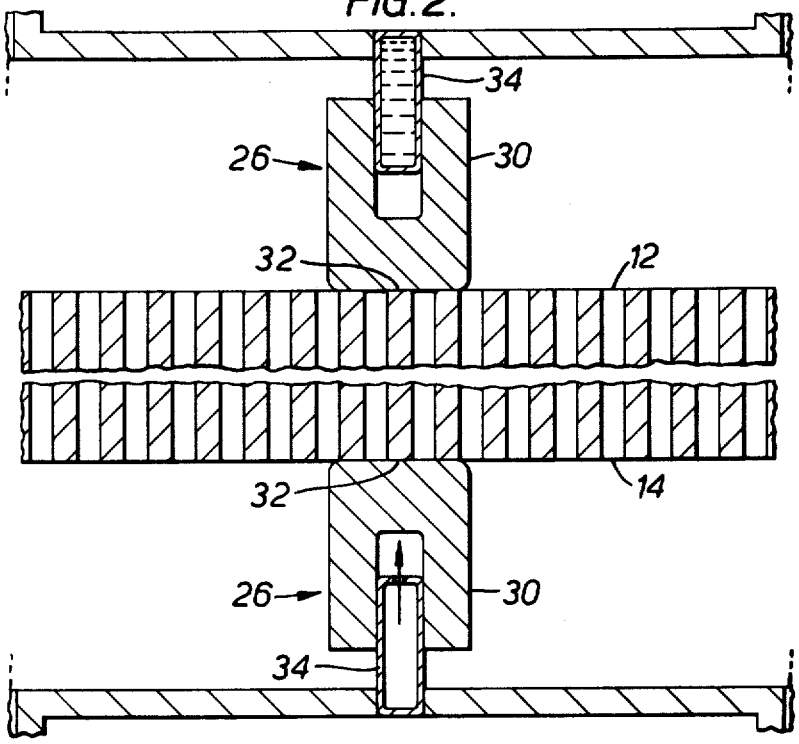
FIG. 2 is a side cross-sectional view on the line II—II of FIG. 1.
Figure 3:
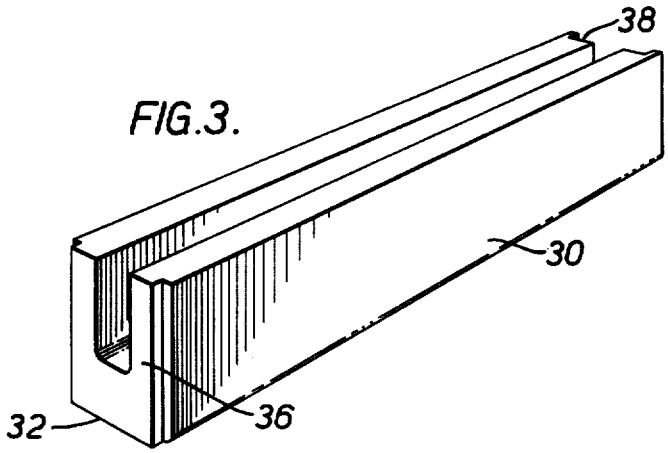
FIG. 3 is a perspective view of a single sealing block.

As will be seen from FIGS. 2 and 3, the flexible seal comprises a plurality of upper and lower sealing blocks 30 arranged in end-to-end relation, each block being of channel shaped configuration with vertically opening channels and having a base 32 bearing in sealing relation upon the respective upper or lower end face 12 or 14 of the matrix 10. The blocks also each being mounted slidably upon a respective fixed upper or lower elongated guide member 34 extending vertically into and horizontally within the channel to laterally restrain the blocks. As is seen in FIG. 1, the guide members 34 are continuous and a single guide member supports a plurality of blocks 30. The guide members 34 for supporting the sealing blocks 30 at the "hot" end face 12 of the matrix may be liquid or gas cooled by the passage of fluid through a continuous closed passage in the guide members and support the sealing blocks to bear in sealing contact with the end face by gravitational bias possibly with fluid pressure or mechanical actuation assistance. The sealing blocks at the "cold" end face 14 of the matrix will not require cooling and the guide members 34 may incorporate some form of upward biassing system to urge the sealing blocks 30 into sealing relation with the lower end face of the matrix. As illustrated diagrammatically in FIG. 2 the lower guide members 34 incorporate fluid-pressure biassing means for their associated sealing blocks 30 although mechanical biassing systems such as springs, torsion bars or counterbalancing systems may be utilised.

As will be seen from FIG. 3 the end faces of each sealing block 30 are shaped to provide a tongue 36 and groove 38 configuration for providing a loose interlocking relation between adjacent sealing blocks permitting relative movement between adjacent blocks whilst at the same time still providing an effective interblock seal and coupling the blocks together.

It will be appreciated that a plurality of such blocks 30 arranged in the configuration illustrated provides a flexible seal which is limitedly movable towards and away from a respective end face 12 or 14 of the matrix 10 to accommodate any distortions which may occur across the end faces due to thermal effects. The sealing blocks themselves may be fabricated from a refractory metal or ceramic material and in the case of blocks fabricated in ceramics a metallic lining may be employed to give improved bending strength properties and also to reduce friction and wear at the block/guide member interface.

The sealing blocks are to be produced as U shaped metallic shoes which carry ceramic insulation, in either solid or fibre form, on the outside of the side walls, and a solid ceramic wearer base which is mechanically attached to the base of the shoe.

Figure 4:
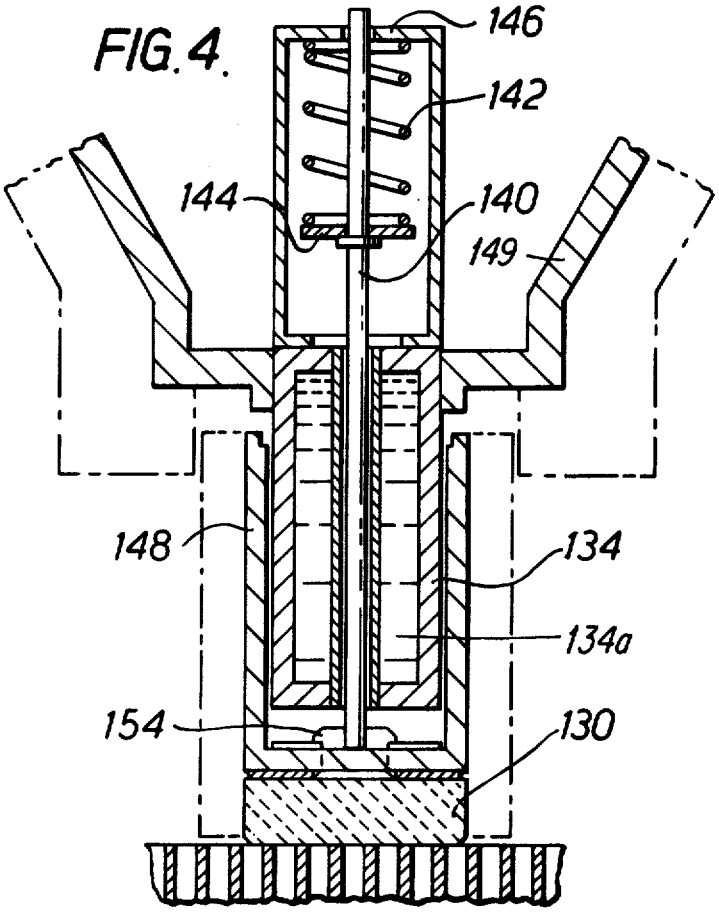
FIG. 4 shows in section one spring-loaded sealing means, together with a cooled guide rail, composite seal block and a mechanical actuation system.

As shown in FIG. 4 a ceramic wearer shoe 130 is supported on a guide 134 by a spring-loaded push rod 140 instead of being biased by fluid pressure as in FIG. 2. The guide 134 is in turn attached to a support member 149. A spring 142 abuts a collar 144 on the rod and an end 146 on the housing. The wearer shoe is connected to a channel shaped metallic liner or block number 148 and this acts as a guide for the remaining portion of the passage or block. Cooling fluid can pass along the void **134*a* within the guide 134. Insulation—shown in chain dotted lines—surrounds the housing 134**.

Figure 5:
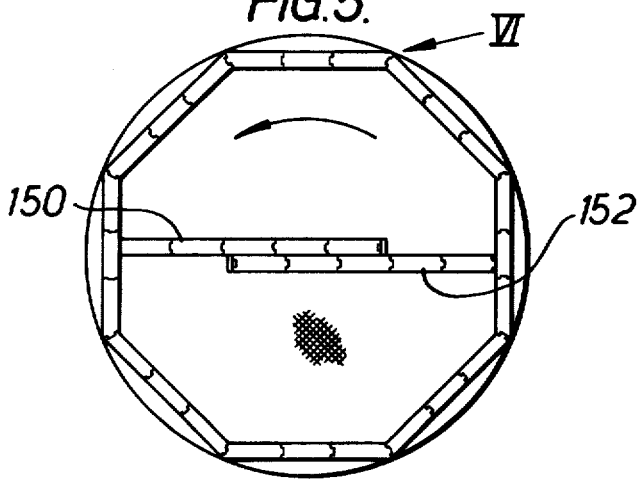
FIG. 5 shows in plan an alternative form of division.

As shown in FIG. 5 the shoes are interlocked at their ends to prevent leakage and have tongue and groove joints for inter-engagement. The centre of the heat exchanger is divided by rows of shoes 150 and 152 which rows are in overlapping relationship along at least a portion of their length and are relatively movable against their interface.

Figure 6:
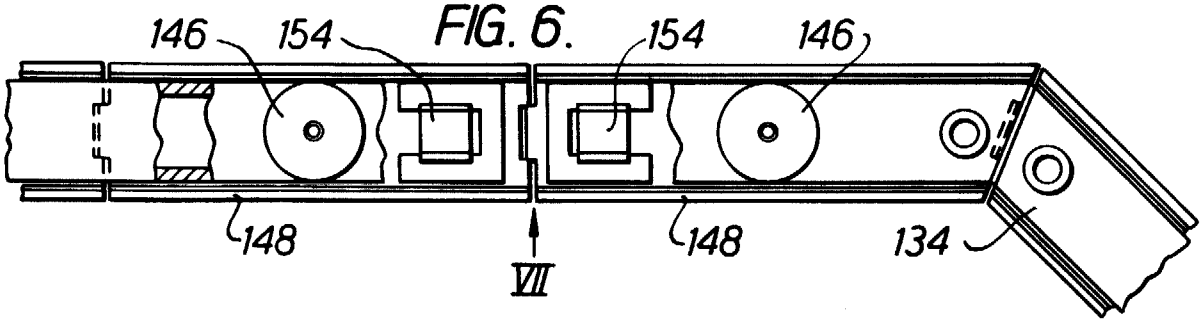
FIG. 6 shows a detailed plan view of the region shown as VI in FIG. 5.
Figure 7:
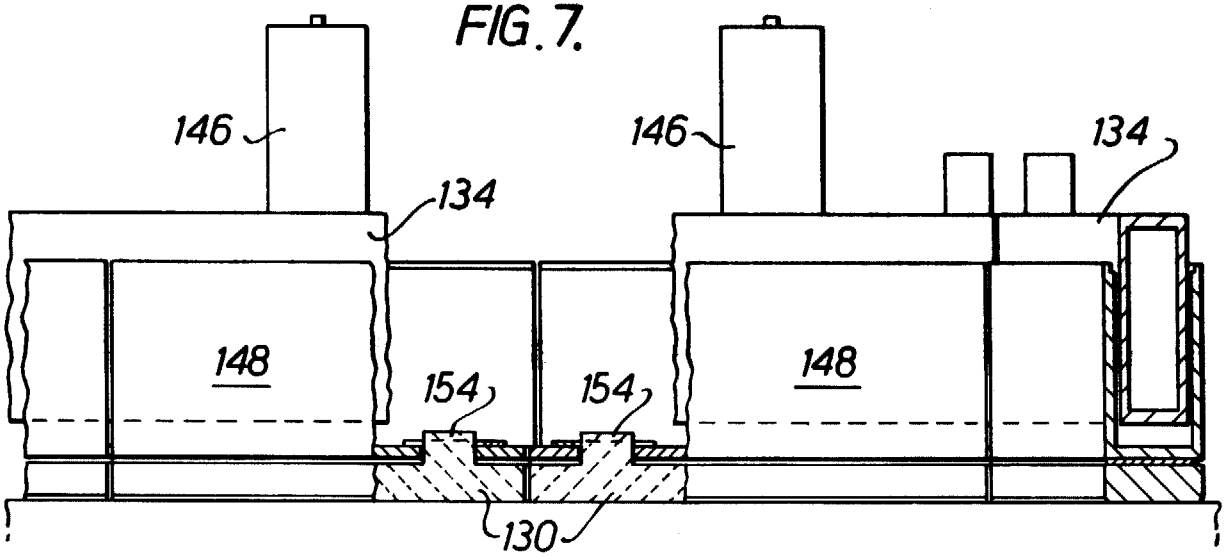
FIG. 7 is a side view on the arrow VII in FIG. 6.

FIG. 6 shows in more detail the inter-engagement of the shoes and shows how the spring housings 146 extend above the inter-engaging portions of the seals. The shoes 130 are connected to the sleeve 148 by means of studs 154 such that the wearing surface of the shoes can readily be replaced. The arrangement shown in FIGS. 5, 6 and 7 relates to a polygonal heat exchanger wherein the perimeter of the passages is polygonal in that the perimeter forms an octagon. There are three block assemblies on each peripheral side of the octagon to form a plurality of flexible seals arranged in end-to-end relationship in alignment with the perimeter of the passages to form, in effect, a polygonal flexible seal.

Figure 8:
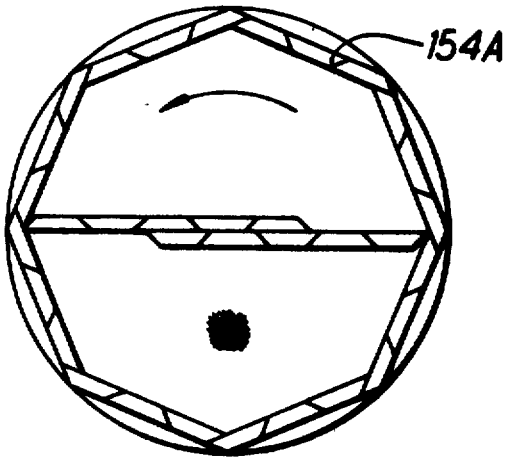
FIG. 8 is another plan view of a variant corresponding to FIG. 5.
Figure 9:
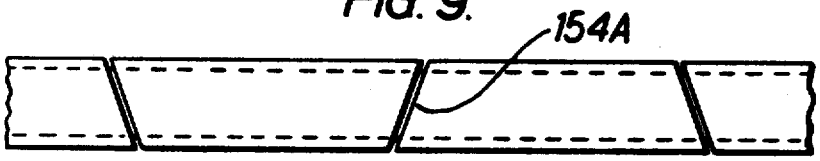
FIGS. 9 and 10 are scrap plan views showing alternative methods of placing blocks in end to end relationship while allowing for longitudinal expansion.
Figure 10:
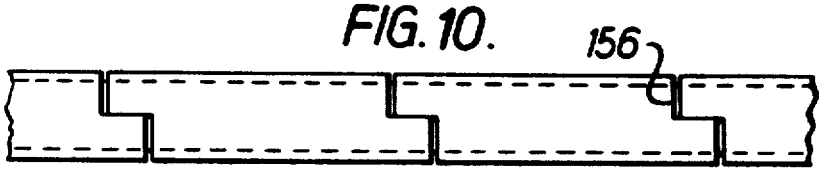

FIG. 8 shows an alternative form of the invention where in the blocks are abutted to each other with scarf connections 156 but otherwise correspond to the arrangement shown in FIGS. 4 to 7. FIGS. 9 and 10 illustrate respectively a scarf connection 154 such as that shown in FIG. 8, and a staggered abutment connection can be used as an alternative.

We claim:

1. Sealing apparatus for a rotary heat exchanger of the regenerative type, wherein the heat exchanger includes a rotatable matrix having two opposed end faces, each of said end faces having a pair of gas passages adjacent thereto with openings aligned therewith, wherein the sealing apparatus is positioned at at least one of the end faces and prevents leakage of gas between the passages aligned with the end face at the interface of the passages and end face; the sealing apparatus comprising:

a plurality of sealing blocks arranged in end-to-end relation and being moveable with respect to one another to provide a flexible sealing means extending along the interface of the passages and end face, each block having a channel therethrough and a ceramic shoe for bearing in sealing relation upon the end face, and guide means extending into each of the channels for laterally restraining the blocks, the guide means including a passageway therethrough for conveying cooling fluid for cooling the blocks.

2. Sealing apparatus as claimed in claim 1 wherein there are flexible sealing means positioned at each of the end faces of the matrix.

3. Sealing apparatus as claimed in claim 2 wherein the flexible sealing means positioned at each end face comprise:

a pair of back-to-back, generally D-shaped portions having a straight portion extending across the respective end face of the matrix between the gas passages and having an arcuate portion extending adjacent the periphery of the respective end face of the matrix.

4. Sealing apparatus as claimed in claim 1 wherein the rotary heat exchanger is oriented to rotate the matrix about a vertical axis so that one of the end faces comprises an upper end face extending in a horizontal plane and the other end face comprises a lower end face extending in a horizontal plane, wherein the sealing apparatus further comprises:

one of said flexible sealing means gravitationally bearing on the upper end face to establish a seal therewith;

a second one of said flexible sealing means for bearing on the lower end face, and means for biasing the second one of the flexible sealing means to bear against the lower end face for establishing a seal therewith.

5. Sealing apparatus as claimed in claim 4 wherein the pair of gas passages aligned with the upper end face of the matrix convey incoming hot gas and outgoing heated air, whilst the two gas passages aligned with the lower end face handle incoming cold air and outgoing cooled waste gas, thereby providing a "hot" upper end face of the matrix and a "cold" lower end face.

6. Sealing apparatus as claimed in claim 5 wherein the biasing means is a spring.

7. Sealing apparatus as claimed in claim 5 wherein the biasing means is fluid pressure.

8. Sealing apparatus as claimed in claim 1 wherein there are two flexible sealing means positioned across the matrix to form two rows, which rows are in overlapping relationship with each other.

9. Sealing apparatus as claimed in claim 1 wherein the sealing apparatus is used with a heat exchanger having passages with openings that have polygonal perimeters and wherein the sealing apparatus comprises:

a plurality of flexible sealing means arranged in end-to-end relation in alignment with the perimeter of the passages to form a polygonal flexible seal with the end face.

10. The sealing apparatus as claimed in claim 9 further including:

a plurality of flexible sealing means arranged in rows which extend across the end face in overlapped relationship with one another between the pair of passages.

11. The sealing apparatus as claimed in claim 5 wherein the openings of the passages have polygonal perimeters and the sealing apparatus aligned with each face comprises:

a plurality of flexible sealing means arranged in end-to-end relation in alignment with the perimeters of the passages to form polygonal flexible seals with the end faces.

12. The sealing means as claimed in claim 11 further including:

a plurality of flexible sealing means arranged in rows which extend across the end faces in overlapped relationship with one another between the pairs of passages.

13. Sealing apparatus for a rotary heat exchanger of the regenerative type wherein the heat exchanger includes a rotatable matrix having upper and lower horizontal end faces and at least one pair of gas passages aligned with each end face, the gas passages aligned with the upper face being for hot gas and those aligned with the lower end faces being for cooler gas with the sealing apparatus disposed between the end faces and gas passages, the sealing apparatus comprising:

upper flexible sealing means resting on the upper end face of the matrix between the matrix and a pair of gas passages to impede mixture of gas in the passages as the matrix rotates while being gravitationally biased against the matrix; the upper flexible sealing means including: a plurality of sealing blocks arranged in end-to-end relation and being moveable with respect to one another for providing the sealing means with flexibility, each sealing block having a vertically opening channel extending therein; vertically extending upper guide means received within the vertically opening channels of the sealing blocks for slidably retaining the blocks as they rest on the upper face of the matrix, and passage means through the upper guide means for conducting a cooling fluid therethrough for cooling the sealing blocks; and lower flexible sealing means biased against the lower end face of the matrix and disposed between the matrix and a pair of gas passages to impede mixture of gas in the passages as the matrix rotates, the lower flexible sealing means including: a plurality of sealing blocks arranged in end-to-end relation and being moveable with respect to one another for providing the sealing means with flexibility, each sealing block having a vertically opening channel extending therein; lower guide means received within the channels for retaining the blocks to slide vertically and biasing means associated with the guide means for urging the sealing blocks into sealing engagement with the lower end face of the matrix.

14. The sealing apparatus of claim 13 wherein the biasing means includes pressurized fluid dispensed from within the lower guide means against the sealing blocks to urge the sealing blocks against the lower face.

15. Sealing block apparatus for use with a flexible sealing means for sealing between gas passageways aligned with an end face of a rotary matrix used in a regenerative heat exchanger, the apparatus comprising:

a block member having a channel therethrough opening from one end of the block member;

a shoe secured to the other end of the block member for engaging the end face;

a support member;

guide means attached to the support means and projecting into the channel;

a passageway in the guide means for conveying a cooling fluid;

a push rod extending through the guide means and secured at one end to the block member, and biasing means on the support member for urging the push rod to project through the guide means to urge the shoe into contact with the end face of the matrix.

16. The sealing block apparatus of claim 15 wherein the block member is metallic, the shoe is ceramic, and the apparatus further includes insulation around the block member and the shoe member.

17. The sealing block apparatus of claim 15 further including coupling means on the ends of the block member for establishing a loose, abutting connection with other block members.

18. The sealing block apparatus of claim 15 wherein the guide means is substantially longer than the block member so as to support additional block members each held in abutting relation with the block member and one another so as to establish a flexible elongated sealing means.

19. The sealing block apparatus of claim 18 wherein the guide means is configured as a polygon and is abutted with a circular matrix end face to seal a polygonal gas passageway aligned with the matrix end face.

20. The sealing apparatus of claim 19 wherein the guide means further includes parallel sections extending transversely and partially across the polygon from opposed sides thereof so as to overlap one another wherein the block members on each guide member are in contact with one another along the overlap of the guide means.

* * * * *